United States Patent [19]

Okamoto et al.

[11] 3,932,687

[45] Jan. 13, 1976

[54] FIBROUS CONFIGURATION COMPOSED OF A PLURALITY OF MUTUALLY ENTANGLED BUNDLES OF FINE FIBERS

[75] Inventors: Miyoshi Okamoto; Koji Watanabe, both of Otsu; Yasuhiko Nukushina, Kyoto; Makoto Konosu, Otsu, all of Japan

[73] Assignee: Toray Industries, Inc., Japan

[22] Filed: Mar. 26, 1973

[21] Appl. No.: 344,620

Related U.S. Application Data

[63] Continuation of Ser. No. 97,328, Dec. 11, 1970, abandoned, which is a continuation of Ser. No. 675,823, Oct. 17, 1967, abandoned.

[30] Foreign Application Priority Data

Oct. 17, 1966 Japan ..... 41-68903
Oct. 21, 1966 Japan ..... 41-67882

[52] U.S. Cl. ..... 428/288; 156/62.4; 162/146; 428/289; 428/290; 428/294; 428/365; 428/394; 428/395; 428/474; 428/480; 428/483; 428/492; 428/521; 428/522; 428/904

[51] Int. Cl.[2]... D04H 1/58; D04H 1/64; D04H 1/74

[58] Field of Search ..... 161/157, 170, 175, 176, 161/81, DIG. 2, 80, 60; 156/62.4; 428/288, 289, 290, 294, 365, 394, 474, 480, 483, 492, 521, 522

[56] References Cited

UNITED STATES PATENTS

| | | | |
|---|---|---|---|
| 2,972,554 | 2/1961 | Muskat | 161/157 |
| 3,272,687 | 9/1966 | Harrington | 161/170 |
| 3,369,948 | 2/1968 | Ostmann | 161/170 |
| 3,400,042 | 9/1968 | Riedesel | 162/146 |
| 3,422,510 | 1/1969 | Livingston | 161/72 |
| 3,493,462 | 2/1970 | Bunting | 161/169 |
| 3,562,374 | 2/1971 | Okamoto | 161/157 |
| 3,705,226 | 12/1972 | Okamoto | 161/DIG. 2 |
| 3,706,613 | 12/1972 | Toki | 161/DIG. 2 |

*Primary Examiner*—George F. Lesmes
*Assistant Examiner*—Ellis P. Robinson
*Attorney, Agent, or Firm*—Robert E. Burns; Emmanuel J. Lobato; Bruce L. Adams

[57] ABSTRACT

A fibrous article having a suede-like surface is composed of numerous staple fiber bundle units mutually entangled with one another in a three-dimensional configuration. Each staple fiber bundle unit comprises a plurality of flexible and relatively movable synthetic organic ultrafine fibers having a substantially round cross-sectional profile, substantially the same fiber length, and lying axially along the longitudinal axis of the staple fiber bundle unit. Elastic bonding material is disposed around and spaced axially along the ultrafine fiber bundle units joining together adjacent ones of the ultrafine fiber bundle units at locations where they intersect with one another to jointly hold the entangled ultrafine fiber bundle units in their three-dimensional configuration while permitting slight relative longitudinal movement between the individual ultrafine fibers within each ultrafine fiber bundle unit. The ultrafine fibers located on at least one surface of the fibrous article have raised ends which are spaced-apart from each other and provide the fibrous article with good handling, touch, softness and excellent durability approaching that of natural leather.

4 Claims, 18 Drawing Figures

Figure 1:
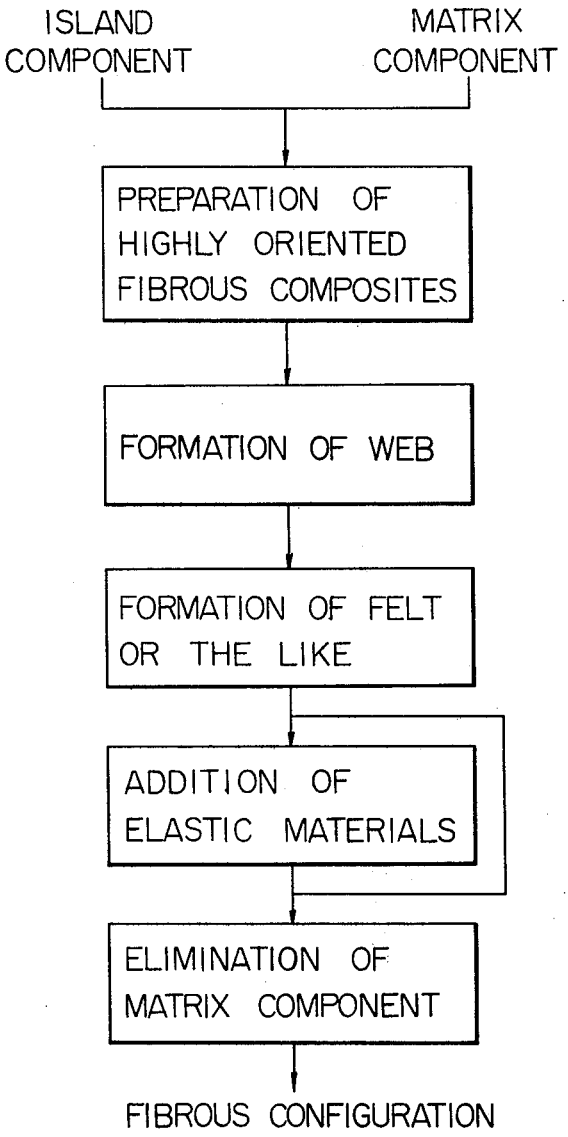

INVENTOR.

BY

INVENTOR.

BY

INVENTOR.

BY

INVENTOR.

BY

FIBROUS CONFIGURATION COMPOSED OF A PLURALITY OF MUTUALLY ENTANGLED BUNDLES OF FINE FIBERS

This is a continuation of application Ser. No. 97,328, filed Dec. 11, 1970, now abandoned, which is a continuation of application Ser. No. 675,823, filed Oct. 17, 1967, now abandoned.

The present invention relates to an improved fibrous configuration mainly composed of mutually entangled bundles of fine fibers which is used for artificial leather or the like.

Many attempts have been made to produce fibrous configuration having the same favorable properties as natural leather, but almost all such attempts have resulted in failure. All of the artificial leather produced by the conventional methods bad hand many unfavorable properties such as less flexibility, had, poor bending strength and permeability etc. The main reason for the failure in the prior art approaches is due to the fact that it was very difficult, and consequently there have been few attempts, to produce a fibrous configuration composed of a plurality of mutually entangled bundles composed of fine fibers, such as that found in the structure of natural leather which is composed of very fine collagen fibers. The natural leather is mainly composed of a plurality of mutually entangled bundles of extremely fine collagen fibers, and the individual collagen fibers contained in the bundle are not chemically bonded to each other thereby permitting slight slippage of the individual fibers within the bundle of fibers when the leather is put under deformation. This is the reason why natural leather is provided with favorable properties. It is extremely difficult to produce such fine fibers artificially by the conventional spinning method used for producing synthetic fibers. Even if such extremely fine fibers could be obtained artificially, it has been quite difficult to produce a uniform web or the like using such extremely fine fibers by the conventional webber. Needle punching of the web composed of such extremely fine fibers was almost impossible because such extremely fine fibers could not withstand the impact applied during the punching operation. Moreover, there have been no suitable methods for collecting such extremely fine fibers into a bundle of fibers and, even if such a bundle of fibers could be obtained, it was difficult to form the plurality of bundles of extremely fine fibers into a mutually entangled condition while maintaining the highly oriented condition of the fibers contained in each individual bundle of fibers.

The so-called Macaroni fiber or multi-hollow fiber is well-known as a conventional material used for the production of artificial leather so as to bestow preferable flexibility and softness to it. But the conventional Macaroni type fibers are not provided with such continuous configuration of bundles of extremely fine fibers as in the structure of collagen fibers of the natural leather. Consequently, it is impossible to expect to bestow sufficient flexibility, softness and high bending strength to the artificial leather produced from the conventional Marcaroni type fibers.

The principal object of the present invention is to provide a fibrous configuration used as artificial leather or the like wherein a plurality of bundles of fine fibers are mutually entangled while permitting a slight slippage of individual fibers within the bundle.

Another object of the present invention is to provide a fibrous configuration used as artificial leather or the like having novel and excellent properties similar to those of natural leather.

A further object of the present invention is to provide a fibrous configuration used as artificial leather or the like having excellent touch, handling and improved durability in practical use which are not present in conventional artificial leather.

Further features and advantages of the present invention will be made apparent from the following descriptions, reference being made to the attached drawings.

Figure 2:
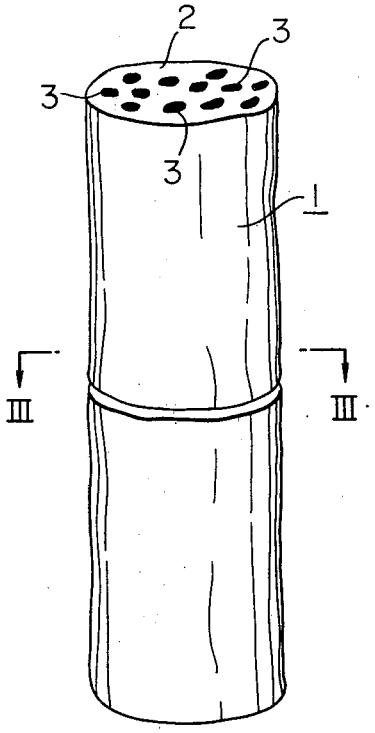
Figure 3A:
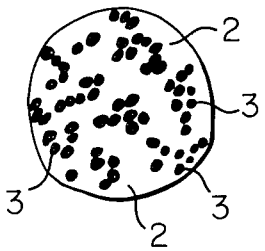
Figure 3B:
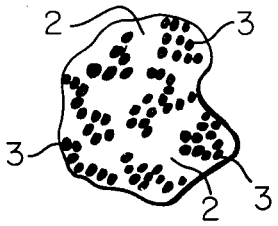
Figure 3C:
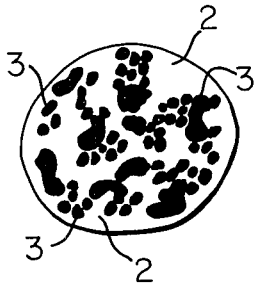
Figure 3D:
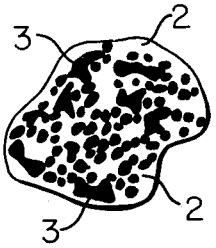
Figure 3E:
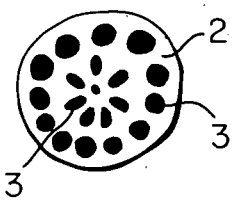
Figure 3F:
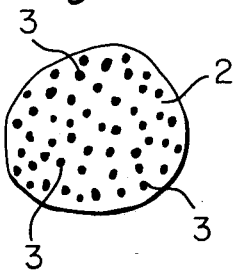
Figure 3G:
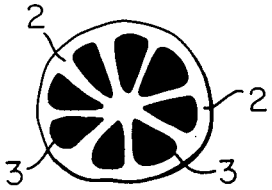
Figure 3H:
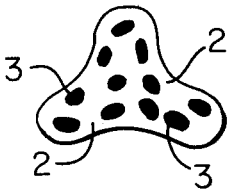
Figure 3I:
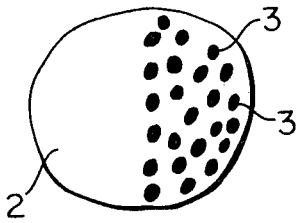
Figure 3J:
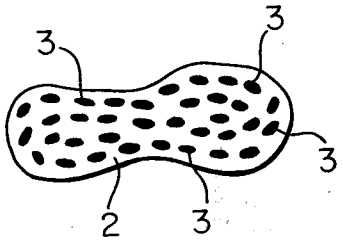
Figure 4:
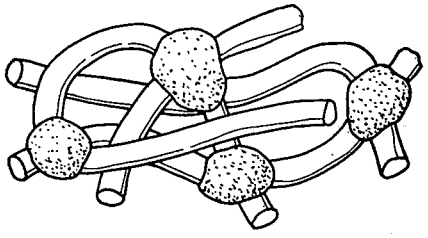
Figure 5:
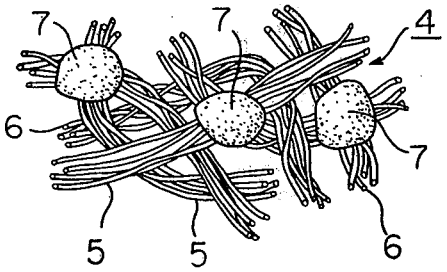
Figure 6:
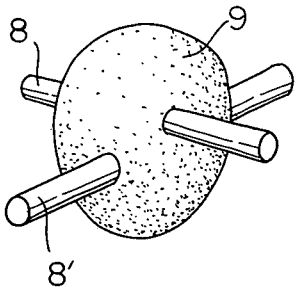
Figure 7:
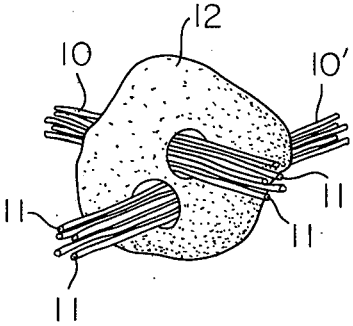
Figure 8:
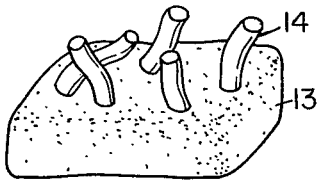
Figure 9:
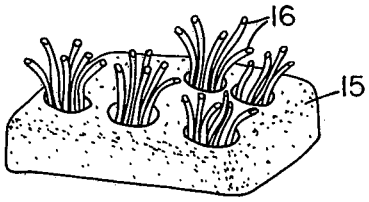

FIG. 1 is a schematic block diagram of an embodiment of the processes for manufacturing fibrous configuration of the present invention, FIG. 2 is a perspective view of a highly oriented fibrous composite of the present invention, FIGS. 3A to 3J are variants of sections taken along the line III—III in FIG. 2, FIG. 4 is an explanatory drawing showing the entangled condition of fibers in the conventional artificial leather, FIG. 5 is an explanatory drawing showing the entangled condition of bundles of fine fibers in the fibrous configuration of the present invention, FIGS. 6 and 7 are explanatory drawings showing the bonded condition of fibers in the conventional artificial leather and the fibrous configuration of the present invention, respectively, and FIGS. 8 and 9 are explanatory drawings showing the surface condition of the conventional artificial leather and the fibrous configuration of the present invention, respectively.

In accordance with the present invention, the manufacture of a fibrous configuration according to the invention comprises the four main processes shown in FIG. 1 following the preparation of highly oriented fibrous configuration, wherein the first process is the formation of a random web, the second process is the formation of a felt or the like, the third process is the addition of elastic materials and the final process is the elimination of at least one of the components from the products. The highly oriented fibrous configuration of the present invention can be prepared in several ways. For example, the fibrous configuration can be prepared by spinning at least two different components simultaneously together through a spinning nozzle in such a manner that the spun filament will have a section as shown in the variants of FIGS. 3A to 3J; by eliminating at least one of the components from the filament thus produced, sizing thus produced bundle of very fine multifilaments so as to form one single filament again; or by sizing a bundle of very fine multifilaments produced by another method, among which the first method is the most favorable. One of the components which is eliminated later, as hereafter described, is called "the matrix component" and the other "the island component" in the following descriptions.

The structure of the highly oriented fibrous composite 1 produced by the above-described method is shown in FIG. 2, wherein the highly oriented fibrous composite 1 comprises a matrix component 2 and a plurality of island components 3 distributed within the matrix component 2.

The cut length of the highly oriented fibrous composite ranges from 25 mm to 100 mm, or preferably from 30 mm to 80 mm, and the thickness of the composite ranges from 1.0 to 20 denier, or preferably from 1.5 to 7 denier, which is approximately equal to that of the fine fibers produced by the conventional method.

The number and the ratio of the island components within the matrix component should be chosen in such a manner that the thickness of the individual fine fibers composed of the island components after the elimination of the matrix component ranges from 0.5 to 0.005 denier, or preferably from 0.10 to 0.01 denier, which is hardly obtainable by the conventional method. Fibers having a fineness in the range of 0.5 to 0.005 denier are referred to herein as ultrafine or simply fine fibers. Some examples of the cross-sectional conditions of the highly oriented composite thus produced are illustrated in FIGS. 3A to 3J. It can be clearly understood from the drawings that the sectional profiles of both the highly oriented fibrous composite 1 and the island components 3 are not always limited to a circular configuration which is shown in FIGS. 2 and 3A. Several types of deformed sectional profiles of the composite such as shown in FIGS. 3B to 3J can be applied without departing from the object of the present invention. But it should be noted that the sectional profile of a highly oriented fibrous composite, in other words, the condition of the distribution of the island components within the matrix component, is kept approximately constant within the cut length along the composite.

The island and the matrix component of the fibrous composite used in the present invention can be chosen from a group composed of polyester group such as polyethyleneterephthalate, polyethyleneterephthalate-isophthalate copolymer, polyethyleneterephthalate-adipate copolymer, polyethyleneterephthalatephthalate copolymer, polyethyleneterephthalate-trimeditate copolymer, polyethyleneterephthalate-sebacate copolymer, polyethyleneterephthalate-succinate copolymer, polyethylene-di-ethylene glycol copolymer. ethylene glycol copolymer, cyclohexane-type-polyester, polyethylenesebacate and polyethyleneadipate; polyamide group such as nylon 6, nylon 66, nylon 12, nylon 4, nylon 10, nylon 11, copolymer of nylon 6 with nylon 66, copolymer of nylon 6 with nylon 10, copolymer of nylon 6 with isophthalamide, copolymer of nylon 6 with polyoxiethylene-di-amine, copolymer of nylon 66 with polyoxiethylene-di-amine, blended polymer of nylon 66 with polyethyleneglycol, blended polymer of nylon 6 with polyethyleneglycol, blended polymer of nylon 6 with above-described copolymers, blended polymer of nylon 66 with above-described copolymers, aromatic polyamides (such as polymethaphenyleneisophthalamide, poly-N-methyl-p-phenyleneterephthalamide); cellulose group such as ivscose rayon, viscose from cupraammonium cellulose, cellulose, acetate, cianoethyl-cellulose; polyvinyl compound group such as polystyrene, polystyrene copolymer, polyacrylonitrilo copolymer containing at least one of methyl-acrylate, methyl-metha-acrylate, ethylacrylate, sodium styrene sulphonate, sodium allyl sulphonate and styrene, polyvinylidenechrolide and polyvinylalcohol; polyurethane group such as diphenylmethane-de-isocyanate-type polyurethane, polytetramethyleneglycol-type polyurethane, polyethyleneglycol-type polyurethane, polypropyleneglycol-type polyurethane and toluene-di-isocyanate type polyurethane, polyolefine group such as polyethylene, polypropylene, polyethylene-i-onomer and their copolymers; polyoxialkilene group such as polyethyleneglycol, polypropylene glycol polyethyleneoxide, polypropyleneoxide, polyoximethylene and polyphenylene; polyfluoro compound groups such as polytetrafluoroethylene (emulsion type), polytrifluoroethylene and polyfluoropropylene.

The combination of the island component with the matrix component must be determined in such a manner that only the latter can easily be eliminated as hereinafter described while the island component is remained so as to form fine fibers. But it does not depart from the object of the present invention to make a portion of the matrix component remain even after the elimination process in accordance with the preference in end use.

The highly oriented fibrous composite thus produced is next fed to the web forming process singly or together with other ordinary fibers which can be produced by the conventional production method in accordance with requirements of the end use. Web forming is performed by the conventional web forming equipment such as a carding machine, a cross wrapper or a random webber, among which the random webber is preferably used for distributing fibers uniformly and randomly within the web.

The webs thus formed are next fed to the needle punching process or the like for the purpose of forming felts having a dimensionally entangled condition of the fibers. Webs composed of the highly oriented fibrous composites of the present invention can be fed to the needle punching process or the like singly or together with other webs, felts, woven cloths, knitted cloths, or non-woven fabrics in an overlapped condition for the purpose of obtaining further improved properties such as the smoothness of surface, tear strength, anisotropic stiffness and crease recovery. The density of needle punching can be determined in accordance with the requirement of the end use, and preferably between 200 to 800 needles/cm$^2$. The formation of the felt can also be performed by the stitch bonding method using such machines as "Arachne", "Maliwatt", "Malipol" or "ACHV".

After the formation of the felt, the felt is treated with a solution or emulsion of elastic materials such as natural rubber, synthetic rubber such as acrylonitlio-butadiene copolymer rubber, styrene-butadiene copolymer rubber, polychloroprene rubber, polybutadiene rubber, polyisoprene rubber, polyethylene-propylene rubber, acrylate-type copolymer rubber and silicone rubber, polyurethane, polyacrylate, polyvinyl acetate and/or polyvinylchloride so as to fix the fibers or highly oriented fibrous composites to each other at their contact portions or to fill the intervening spaces with such materials. Addition of elastic materials can be carried out by the immersion method, spraying method, foaming method, printing method or coating method, in the condition of solution, emulsion or powder, but among these the immersion method is most preferable for the purpose of the present invention. Such elastic materials added to the felt are coagulated by any of the well-known methods.

The quantity of the materials added to the felt is determined in accordance with the requirements of the end use, and preferably ranges from 50 to 300 % by weight of the total island components contained in the felt to be treated. As a result of this addition of elastic materials, the mechanical property of the fibrous configuration produced is greatly improved.

After the addition of elastic materials, the felt is next treated with a suitable chemical solvent for eliminating the matrix component from the highly oriented fibrous composites contained in the fibrous configuration in a mutually entangled and partially fixed condition. The chemical solvent used for this process should be chosen so that it does not damage the island components and not lower the fixing ability of the elastic materials added to the felt in the foregoing process.

Referring to FIGS. 4 and 5, examples of the entangled condition of fibers in the case of the conventional artificial leather or the like and the fibrous configuration of the present invention are shown, respectively. Before the elimination of the matrix component, the highly oriented fibrous composites are distributed within the felt in a mutuallly entangled condition in a manner similar to the case of the conventional artificial leather or the like shown in FIG. 4. However, after eliminating the matrix components as described above, each highly oriented fibrous composite is converted into a bundle of fine or ultrafine fibers mainly composed of island components while maintaining the mutually entangled condition in the felt as shown in FIG. 5. Consequently, the resulting fibrous configuration 4 is composed of a plurality of mutually entangled bundles 5 of fine fibers 6, some of which are fixed to each other by a suitable elastic material 7 at their contact portions.

The fixed portions of the fibers in the conventional artificial leather or the like and the fibrous configuration of the present invention are shown in FIGS. 6 and 7 respectively. In the case of the conventional artificial leather or the like, the contact portion of the fibers 8 and 8' contained therein are firmly fixed to each other by the elastic material 9 fed to the felt, and because each contact portion or the fibers in the construction is thus firmly fixed by the elastic material, the free movement of individual fibers within the resultant structure is very limited, resulting in poor handling quality and flexibility of the artificial leather or the like produced therefrom. On the contrary in the case of the fibrous configuration of the present invention, the contact portions of the highly oriented fibrous composites contained therein are firmly fixed to each other by the elastic material added to the felt as in case of the conventional artificial leather, at the stage of formation before the elimination of the matrix component from the composite and after the matrix component is removed, the individual fibers within each fiber bundle are movable relative to one another. It will be well understood that the effective cross sectional area of a bundle of fine fibers obtained by eliminating the matrix component from a highly oriented fibrous composite is smaller than the cross sectional area of the original fibrous composite. Therefore it can be expected that slight clearances are formed between the bundles 10, 10' of the fine fibers 11 and the elastic material 12 after the elimination of the matrix component as shown in FIG. 8. On account of the presence of such slight clearances, each contact portion of the bundles is dimensionalily restricted but is not firmly fixed by the elastic material, and the free movement of individual fiber bundles within the configuration is not as limited as in the case of the conventional artificial leather or the like. In addition because the slacked condition of the bundle of fibers is not too constricted by the elastic material as described above, the free movement of the individual fibers relative to each other within the bundle is permitted and the greater freedom at the movement of both of the bundles within the configuration and fibers within the bundles results in improved handling quality, flexibility and permeability of the fibrous configuration produced therefrom.

Referring to FIGS. 8 and 9, the enlarged surface conditions of the conventional artificial leather and the fibrous configuration of the present invention are shown respectively. As is obvious from the drawing, the conventional artificial leather or the like has an exposed surface of the elastic material 13 out of which a plurality of end portions 14 of fibers of larger denier contained within the felt are extending, and this construction yields a rough and hard touch to the surface of the artificial leather produced. While in the case of the fibrous configuration of the present invention, the exposed surface of the elastic material 15 is provided with a plurality of raised and spaced-apart end portions 16 of fine fibers after the elimination of the matrix component as shown in FIG. 9, and such a great number of raised ends provide the fibrous configuration with a velvety surface and deerskin-like touch which could hardly be obtained by the conventional method for producing artificial leather. Instead of adding elastic material to the felt of the present invention, such plastic materials as softened nylon 6, softened polyvinylchloride or polyethylene of low density can also be used without departing from the object of the present invention.

Moreover, the fibrous configuration of the present invention possesses a remarkably improved fatigue limit under bending when compared with the conventional artificial leather or the like because of the fact that the stress concentration can effectively be prevented by distributing the loaded force on individually separated fine fibers.

The fibrous configuration of the present invention can be provided with further additional properties in accordance with the requirements of the end use by passing it through heat pressing, dyeing, slicing, coating, water proofing or buffing treatment the same as in the case of the conventional artificial leather and the like, among which the buffing operation is most important for improving the surface condition of the fibrous configuration of the present invention. It is also preferable to bestow crimps to the highly oriented fibrous configuration and performing the conventional scouring by water, drying and softening after the elimination of the matrix component.

The following examples are illustrative of the present invention but are not to be construed as limiting the same.

EXAMPLE 1

The highly oriented fibrous composites are prepared under the processing condition shown in Table 1.

Table 1

| | | |
|---|---|---|
| Island | component | |
| | Composition | Polyethyleneterephthalate containing 0.5 % of $TiO_2$ |
| | Intrinsic viscosity | 0.66 (in orthochloro phenol at 25°C) |
| | Content | 30 parts by weight |
| Matrix | component | |
| | Composition | Nylon 6 containing 0.5 % of $TiO_2$ |
| | Relative viscosity | 2.35 (in sulfuric acid) |
| | Content | 70 parts by weight |
| Spinning temperature | | 285°C |
| Number of island components in one composite | | 48 |
| Thickness of a single composite | | 7.5 denier |
| Thickness of a single fine | | |

Table 1-continued

| | |
|---|---|
| filament in the bundle (island) | 0.047 denier |
| Take-up speed | 1,000 m/min. |

After spinning, the highly oriented fibrous composites were drawn at a drawing ratio of 4.1 at a temperature of 175°C, bestowed 12 crimps/inch, heat-set at 120°C for 30 min. and cut into length of 51 mm. The cut composites are fed to a cross-wrapper to produce webs having weight of 250 g/m². Four of the webs produced were overlapped together and needle-punched on a locker-room with a punching density of 480 needles/cm². Then the felt was treated with a 40% solution of NBR latex so as to be bestowed 70% of the latex in relation with the quantity of the highly oriented fibrous composites, and the bestowed latex was coagulated by treating the felt in a 1.5% solution of calcium chloride for 5 minutes. Then the felt was dried at 120°C for 50 min. after washing at 80°C for 10 min. with water. After the bonding process, the felt was further treated in formic acid at 24° C for 30 min. so as to eliminate the nylon 6, matrix component, from the fibrous configuration produced.

The properties of the resulting fibrous configuration are shown in Table 2 together with those of the conventional artificial leather for comparison.

Table 2

| | Fibrous configuration of the invention (example 1) | Conventional artificial leather (comparative example 1) |
|---|---|---|
| Thickness of individual fibers | $0.047^d$ | $4^d$ (nylon 6) |
| Length of individual fibers | 51 mm | 51 mm |
| Added elastic material | NBR | NBR |
| Thickness of the product | 1.35 mm | 1.30 mm |
| Weight of the product | 456 g/m² | 483 g/m² |
| Tensile strength | 14 kg/cm² | 12 kg/cm² |
| Gurley's stiffness | 350 mg | 1850 mg |
| Bending strength at −5°C | more than 1,000,000 | less than 200,000 |

The produced fibrous configuration has a deerskin-like preferable handling and touch with remarkably improved mechanical properties.

EXAMPLE 2

A felt was prepared in the same manner as described in Example 1 using highly oriented fibrous composites obtained in Example 1. Then the felt was treated with a 15% DMF solution of polyurethane so as to be bestowed 55% of polyurethane in relation with the quantity of the highly oriented fibrous composites, and the bestowed polyurethane was coagulated by treating the felt in water at 30°C for 25 min. Then the felt was dried at 100°C for 20 min. after washing at 80°C for 30 min. with water. After the bonding process, the felt was further treated in a solution composed of 70 parts by weight of calcium chloride and 30 parts by weight of methanol at 50°C for 30 min. so as to eliminate the nylon 6, matrix component, from the fibrous configuration produced. And then the felt was dried after washing with water.

The produced fibrous configuration has a preferable handling and touch like that of natural leather the same as in the case of Example 1.

EXAMPLE 3

A felt, which was prepared in the same manner as in Example 1, was treated with a 40% solution of NBR latex so as to be bestowed 50% of latex in relation with the quantity of the highly oriented fibrous composite contained in the felt, and the bestowed latex was coagulated by treating the felt in a 15% solution of calcium chloride at 50°C for 5 min. After the bonding process, the felt was further treated in a 15% hydrochloride solution at 90°C for 15 min. so as to eliminate the nylon 6, matrix component, from the fibrous configuration produced. Then the felt was dried after washing with water. Next the fibrous configuration was sliced into layers having the thickness of 0.7 mm. The sliced surface of the layer was then coated 350 g/m² with a coating agent (whose composition is shown in Table 3) and the coating agent was coagulated by immediately immersing the layer into water at 40°C. After coagulation, the surface of the layer was washed, embossed and buffed.

The obtained layer has a colored-sheepskin-like appearance with preferable handling, softness and touch like that of natural leather.

Table 3

| Composition of coating agent | Parts by weight |
|---|---|
| Polyurethane | 80 |
| Carbon black | 20 |
| DMF | 300 |

EXAMPLE 4

A felt prepared in the same manner as in Example 1 was treated with the elastic material shown in Table 4 so as to be bestowed 15% of the material in relation with the quantity of the highly oriented fibrous composite contained in the felt and the felt was immediately coated 550 g/m² with the same coating agent as used in Example 3 so as to make a portion of the coating agent permeate into the felt and the elastic material. Both the elastic material and the coating agent were coagulated by immersing the felt into water of 40°C for eliminating DMF completely.

Table 4

| Composition of elastic material | Parts by weight |
|---|---|
| Polyurethane | 15 |
| Carbon black | 5 |
| DMF | 80 |

After drying, nylon 6 was eliminated in the same manner as in Example 2 and then the felt was dried after washing with water. The coated surface of the fibrous configuration produced was embossed and another surface buffed by sand-paper.

The obtained fibrous configuration has a cowskin-like appearance with preferable softness, handling, touch and durability like that of natural leather.

EXAMPLE 5

The highly oriented fibrous composite ($5^d \times 38$ mm), which was composed of 50 parts by weight of polyethyleneterephthalate as the island component and 50 parts by weight of nylon 6 as the matrix component, was prepared in the same manner as in Example 1. A web formed from the highly oriented fibrous composites obtained in the same manner as in Example 1 was needle-punched, bonded with NBR late and treated with 15% hydrochloride solution for the elimination of the nylon 6, matrix component.

The obtained fibrous configuration has a preferable appearance with preferable handling and touch like that of natural leather.

EXAMPLE 6

The highly oriented fibrous composite ($7^d \times 76$ mm), which was composed of 30 parts by weight of polypropylene as the island component and 70 parts by weight of polyethyleneterephthalate as the matrix component, was prepared in the same manner as in Example 1. A web formed from the highly oriented fibrous composite in the same manner as in Example 1 was needle-punched, bonded with polyurethane, and treated with a 90% phenol solution for the elimination of polyethylene terephthalate, matrix component.

The obtained fibrous configuration has a preferable appearance with preferable handling and touch like that of natural leather.

EXAMPLE 7

The highly oriented fibrous composite ($5.7^d \times 51$ mm), which was composed of 60 parts by weight of polyethyleneterephthalate as the island component and 40 parts by weight of polystyrene as the matrix component, is prepared in the same manner as in Example 1 with the exception that the number of island components in one composite was 72. A web formed from the highly oriented fibrous composite in the same manner as in Example 1 is needle-punched, bonded with polyurethane, and treated with trichloroethylene for the elimination of the polystyrene matrix component.

The obtained fibrous configuration has a deerskin-like appearance with preferable handling and touch like that of natural leather.

EXAMPLE 8

The highly oriented fibrous composite ($4.7^d \times 51$ mm), which was composed of 50 parts by weight of nylon 6 as the island component and 50 parts by weight of polystylene as the matrix component, was prepared in the same manner as in Example 7. A web formed of the highly oriented fibrous composite in the same manner as in Example 7 was needle-punched, bonded with polyurethane, and treated with perchloroethylene for the elimination of the polystyrene, matrix component.

The obtained fibrous configuration has a preferable appearance with preferable handling and touch like that of natural leather.

EXAMPLE 9

A web was formed of 75 parts by weight of highly oriented fibrous composite ($1.5^d \times 38$ mm) obtained in Example 1 and 25 parts by weight of high shrinkable polyethyleneterephthalatetype copolymer, needle-punched, bonded with NBR latex, and treated with 15% hydrochloride solution for the elimination of the nylon 6, matrix component. After the elimination of the matrix component, the produced fibrous configuration was treated with boiling water for the purpose of obtaining high density configuration by shrinking polyethyleneterephthalate copolymer fibers, which presented a deerskin-like appearance with preferable handling and touch like that of natural leather.

Several fibrous configurations of the present invention and of the conventional production method were prepared according to the processing conditions shown in Table 5, and the properties of the resulting products are illustrated in Table 6 for comparison.

Table 5

| Example No. | Material fiber | Composition parts by weight | | Production method | Elastic materials | Thickness of the product in mm. |
|---|---|---|---|---|---|---|
| 10 | HOFC | Polyester<br>Nylon 6 | 30<br>70 | Same as Example 1 | NBR | 0.7 |
| 11 | " | " | | " | " | 1.5 |
| 12 | " | " | | " | " | 1.3 |
| 13 | " | " | | " | SBR | 1.4 |
| Comparative 2 | Ordinary fiber | HS nylon<br>Nylon 6 | 50<br>50 | Conventional (Blended fiber) | NR 80 %<br>NBR 20% | 1.4 |
| " 3 | " | " | | " | " | 1.5 |
| " 4 | " | " | | " | " | 1.4 |
| " 5 | " | " | | " | " | 1.4 |
| 14 | HOFC | Polyester<br>Nylon 6 | 35<br>65 | Same as Example 1 | NBR | 1.8 |
| 15 | " | " | | Same as Example 2 | Polyurethane | 2.1 |
| Comparative 6 | Ordinary fiber | HS polyester<br>Nylon 6 | 30<br>70 | Conventional (Blended fiber) | NBR | 1.9 |
| 16 | HOFC | PET<br>Polystyrene | 60<br>40 | Same as Example 1 | None | 1.9 |
| Comparative 7 | Ordinary fiber | Nylon 6 | | Same as Example 1 | None | 3.7 |

Table 5-continued

| Example No. | Material fiber | Composition parts by weight | Production method | Elastic materials | Thickness of the product in mm |
|---|---|---|---|---|---|
| 8 | " | PET | " | " | 1.9 |

Symbols: NBR; Natural-butadiene rubber
SBR; Styrene-butadiene rubber
NR; Natural rubber
HS; High shrinkable
PET; Polyethyleneterephthalate
HOFC; Highly oriented fibrous composites Table 6

| Example No. | Gurley's stiffness | Handling by grip test | Surface touch by rubbing test |
|---|---|---|---|
| 10 | 435 mg | good 100 % | good 100 % |
| 11 | 601 mg | " | " |
| 12 | 959 mg | " | " |
| 13 | 1444 mg | " | " |
| Comparative 2 | 2500 mg | poor 100 % | poor 100 % |
| " 3 | 3150 mg | " | " |
| " 4 | 2300 mg | " | " |
| " 5 | 3150 mg | " | " |
| 14 | 1043 mg | good 100 % | good 100 % |
| 15 | 1518 mg | " | " |
| Comparative 6 | 3889 mg | poor 100 % | poor 100 % |
| 16 | A; 25 mg<br>B; 17 mg | good 100 % | good 100 % |
| Comparative 7 | A; 193 mg<br>B; 133 mg | poor 100 % | poor 100 % |
| " 8 | A; 183 mg<br>B; 153 mg | " | " |

In the table, A designates Gurley's stiffness of the sample taken along the direction of the product delivery from the machine, while B designates Gurley's stiffness of the sample taken along the direction perpendicular to the products delivery from the machine.

Handling and surface touch are both indicated by the percentage of the examiners who examined the sample as described in the table in relation to the total number of the examiners.

What is claimed is:

1. A fibrous article comprising: numerous staple fiber bundle units mutually entangled with one another in a three-dimensional configuration, each said staple fiber bundle unit comprising a plurality of flexible and relatively movable synthetic organic ultrafine fibers having a denier within the range of 0.005 to 0.5 denier per one ultrafine fiber, substantially the same fiber length and lying axially along the longitudinal axis of said staple fiber bundle unit; elastic bonding material disposed around and spaced axially along said ultrafine fiber bundle units joining together adjacent ones of said ultrafine fiber bundle units at locations where they intersect with one another to hold the entangled ultrafine fiber bundle units in said three-dimensional configuration while permitting slight relative longitudinal movement between the individual ultrafine fibers within each ultrafine fiber bundle unit; and wherein the ultrafine fibers located on at least one surface of said fibrous article have raised ends which are spaced-apart from each other.

2. A fibrous article according to claim 1; wherein said ultrafine fibers within each fiber bundle unit have a generally round cross-sectional profile.

3. A non-woven fibrous sheet comprising: numerous ultrafine staple fiber bundle units entangled with one another in a three-dimensional configuration, each ultrafine fiber staple bundle unit having a total denier of 7.0 or smaller and being composed of a plurality of ultrafine staple fibers composed of a fiber-forming polymer selected from the group consisting of polyesters and polyamides and having a denier within the range of 0.005 to 0.5 denier per one ultrafine fiber, a length of from 25mm to 100mm, and lying substantially axially along the longitudinal axis of said staple fiber bundle unit; and elastic bonding material comprising a polymer selected from the group consisting of natural rubber, synthetic rubbers, polyurethanes, polyacrylic esters, polyvinyl chloride and polyvinyl acetate disposed around and spaced axially along said ultrafine fiber bundle units joining together adjacent ones of said ultrafine bundle units at locations where they intersect with one another to hold the entangled ultrafine fiber bundle units in said three-dimensional configuration while permitting slight relative longitudinal movement between the individual ultrafine fibers within each ultrafine fiber bundle unit; and wherein the fibrous sheet has at least one raised surface defined by numerous raised ends of said ultrafine staple fibers covering the fibrous sheet surface such that the root ends of the raised ultrafine staple fibers are connected to said fibrous sheet and the raised ends are spaced-apart from each other.

4. A non-woven fibrous sheet according to claim 3; wherein said plurality of ultrafine staple fibers within each fiber bundle unit have a generally round cross-sectional profile.

* * * * *